US006513264B2

(12) United States Patent
Sinaie

(10) Patent No.: US 6,513,264 B2
(45) **Date of Patent: *Feb. 4, 2003**

(54) ORTHOSES INSERT FOR METATARSALGIA AND DIABETIC PATIENTS

(76) Inventor: Moshe Sinaie, 212 W. 91st St., #507, New York, NY (US) 10024

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/315,556

(22) Filed: May 20, 1999

(65) Prior Publication Data

US 2002/0069555 A1 Jun. 13, 2002

(51) Int. Cl.[7] ..... A43B 13/38
(52) U.S. Cl. ..... 36/43; 36/71; 36/140
(58) Field of Search ..... 36/43, 44, 71, 36/31, 140, 88

(56) References Cited

U.S. PATENT DOCUMENTS 4,408,402 A * 10/1983 Looney ..... 36/43
4,615,126 A * 10/1986 Mathews ..... 36/31
4,633,877 A * 1/1987 Pendergast ..... 36/44
5,154,682 A * 10/1992 Kellerman ..... 36/44
5,438,768 A * 8/1995 Bauerfeind ..... 36/43
5,509,218 A * 4/1996 Arcan et al. ..... 36/43
5,768,803 A * 6/1998 Levy ..... 36/43

* cited by examiner

*Primary Examiner*—M. D. Patterson
(74) *Attorney, Agent, or Firm*—Gottlieb, Rackman and Reisman, P.C.

(57) ABSTRACT

A novel insole orthoses pad that may be inserted into a shoe alleviates the formation of ulcers aggravated by plantar shear forces and vertical forces. The insole orthoses pad, has vertically aligned strips of a material that support and cushion vertical forces alternated with a more flexible material that allows the supporting material to move from proximal-lateral to distal medial in response to shear forces without abrading the plantar surface. The combination of alternating strips of material are aligned so as to anticipate the orientation of the shear forces generated during the execution of a step by the wearer.

Arcs of cushioning material are provided on a pad to protect likely sites of ulcer formation, having an orientation direction that is the average of the locus of maximum pressure in order to reduce the rubbing of the cushion material due to shear forces.

2 Claims, 4 Drawing Sheets

ORTHOSES INSERT FOR METATARSALGIA AND DIABETIC PATIENTS

FIELD OF THE INVENTION

This invention relates to orthoses such as insole materials to reduce the incidence and severity of ulcers in persons with diabetes. In addition the invention relates to the reduction of metatarsalgia. In particular the invention relates to the configuration of known materials to best relieve the effect of vertical forces as well as shear forces during walking or running.

BACKGROUND OF THE INVENTION

Persons having diabetes are susceptible to the development of ulcers on the soles of their feet that are difficult to heal due to compromised circulation and neuropathies and are a dominant contributing cause of limb amputation in diabetics. The usual treatment is to relieve peak plantar foot pressure at the site of the ulceration. Many devices are known to relieve peak plantar pressure, as discussed in Fleischli, et al., "Comparison of Strategies for Reducing Pressure at the Site of Neuropathic Ulcers" 87 J.Am-.Pod.Med.Assn. 466–72 (1997). Since 94% of diabetic ulcers occur under areas of increased pressure, Boulton, et al., "Reduction of abnormal foot pressures in diabetic neuropathy using a new polymer insole material" 7 Diabetes Care 42 (1984), ulcer treatments have focused on reducing such pressures. Casts, orthoses, and other off-loading devices have been utilized. Suggested devices include the plaster total cast, rigid-soled postoperative shoes, removable walking casts, half-shoes, accommodative felt dressings and foam dressings.

Each of these devices has drawbacks in terms of convenience, cost, and/or effectiveness. Total casts have been the most effective, but the technique requires special training and must be changed every 7 to 10 days. If not applied properly the casts may lead to iatrogenic ulcers. The cast also prevents the patient from inspecting their wounds for signs of infection and deterioration. As a result total contact casts have not been widely used by podiatrists or other physicians. Removable walking casts have been more successful.

The half shoe has an increased heel are in order to diminish forces in the forefoot area. Half shoes have contributed, however, to unsteadiness in ulcer patients, requiring the patient to use crutches.

Accommodative dressings made of felt and polyethylene foam involves the use of an aperture pad cut from felt and foam that is placed on the foot in an attempt to reduce pressure. See Gutzman, et al., "Pressure-removing strategies in neuropathic ulcer therapy", 11 Clin.Pod.Med.Surg. 339 (1994); Ritz et al., "A successful technique for the treatment of diabetic neurotrophic ulcers, 82 JAMA 479 (1992). The use of such pads has been criticized because the edge of an aperture pad "could serve as a focus of increased pressure and shear forces and thereby delay healing or even increase ulcer size," Fleischli, op. cit. p.471.

Examples of insole orthoses are the Bauerfiend Viscoped and the Langer Blueline. Kelly, et al., "Use of Ready-Made Insoles in the Treatment of Lesser Metatarsalgia", 19 Foot & Ankle International 217 (1998). The Bauerfiend Viscoped is a silicone insole with a fixed position of the metatarsal dome and a series of inserts of softer viscoelastic blue silicone corresponding to the positions of the metatarsal heads and heel. The Langer Blueline is a Plastazote insole with variable metatarsal dome and wedge placement. Plastazote is an open-cell foam capable of non-elastic deformation.

Materials use to reduce plantar pressure include Plastazote—a moldable foamed polyethylene of closed construction, latex foam—a cellular rubber, Dynafoam—a polyvinyl chloride foam that quickly forms an impression of the foot, Ortho felt—a resilient blend of cotton and wool with low tensile strength, Spenco—a neoprene sponge covered with multistretch nylon, Molo—a combination of latex, jells, leather, and cork incorporated into a rubbery sheet, PPT—an open cell, porous, firm foam material that doesn't bottom out under pressure, shock or shear. See Leber et al., "A comparison of shoe insole materials in plantar pressure relief," 10 Prosthetics & Orthotics Intl. 135–38 (1986).

The effect of shear forces to aggravate ulcer formation has been noted. Bauman et al., "Plantar Pressures and Trophic Ulceration," 45B J.Bone & Joint Surg. 652–73 (1963), noted that when the skin of the foot rubs on a shoe or ground, friction is produced and a blister forms that may become an ulcer. Movement takes place between the skin and bone through soft tissues. Once tissues have been scarred by previous ulceration the loss of elasticity allows shear forces to tear tissues rather than stretch them. Bauman et al. suggested that such a factor should be considered in the design of shoes for active people with anaesthetic feet. He suggests the gradual breaking in of new shoes and the wearing of a second pair of socks. Bauman et al. noted the difficulty of measuring shear forces and concentrated on the measurement of perpendicular pressures alone. Their preference was to use microcellular rubber for an insole material.

The techniques for measurement of shear forces on the plantar surface of the foot is summarized in Davis et al., "A Device for Simultaneous Measurement of Pressure and Shear Force Distribution on the Plantar Surface of the Foot," 14 J.Applied Biomechanics 93–104 (1998). Davis et al. recognize the importance of identifying sites of maximum shear as well as pressure in working with diabetic individuals to lessen the effects of ulceration. They note that for most individuals in their trials the sites of maximum pressure and shear did not correspond.

BRIEF DESCRIPTION OF THE INVENTION

The present invention provides novel insole orthoses to alleviate the formation of ulcers aggravated by plantar shear forces and vertical forces. The invention comprises two embodiments which may be used separately or in conjunction. One embodiment is an insole orthoses pad that may be inserted into a shoe, which has vertically aligned strips of a material that support and cushion vertical forces alternated with a more flexible material that allows the supporting material to move from proximal-lateral to distal medial in response to shear forces without abrading the plantar surface. In a preferred embodiment the combination of alternating strips of material are aligned so as to anticipate the orientation of the shear forces generated during the execution of a step by the wearer.

In a second embodiment, arcs of cushioning material are arranged on a pad to protect likely sites of ulcer formation, in an orientation direction that is the average of the locus of maximum pressure in order to reduce the rubbing of the cushion material due to shear forces.

The invention produces gradual reduction of propagation of the shear forces without comprising the cushioning of the vertical forces, and produces isolation of the surrounding tissue from vertical and transverse forces at the maximal pressure points or where ulcers have formed.

DETAILED DESCRIPTION OF PREFERRED EMBODIMENTS

Figure 1:
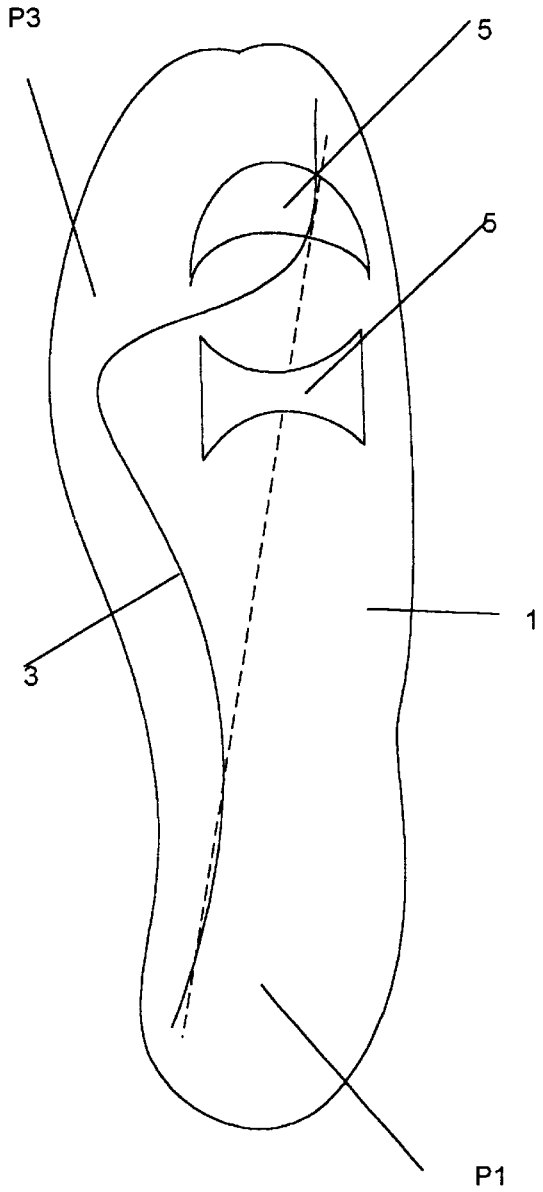
FIG. 1 is a bottom view of a foot indicating the locus of points of maximum vertical pressure during a walking step.
Figure 2:
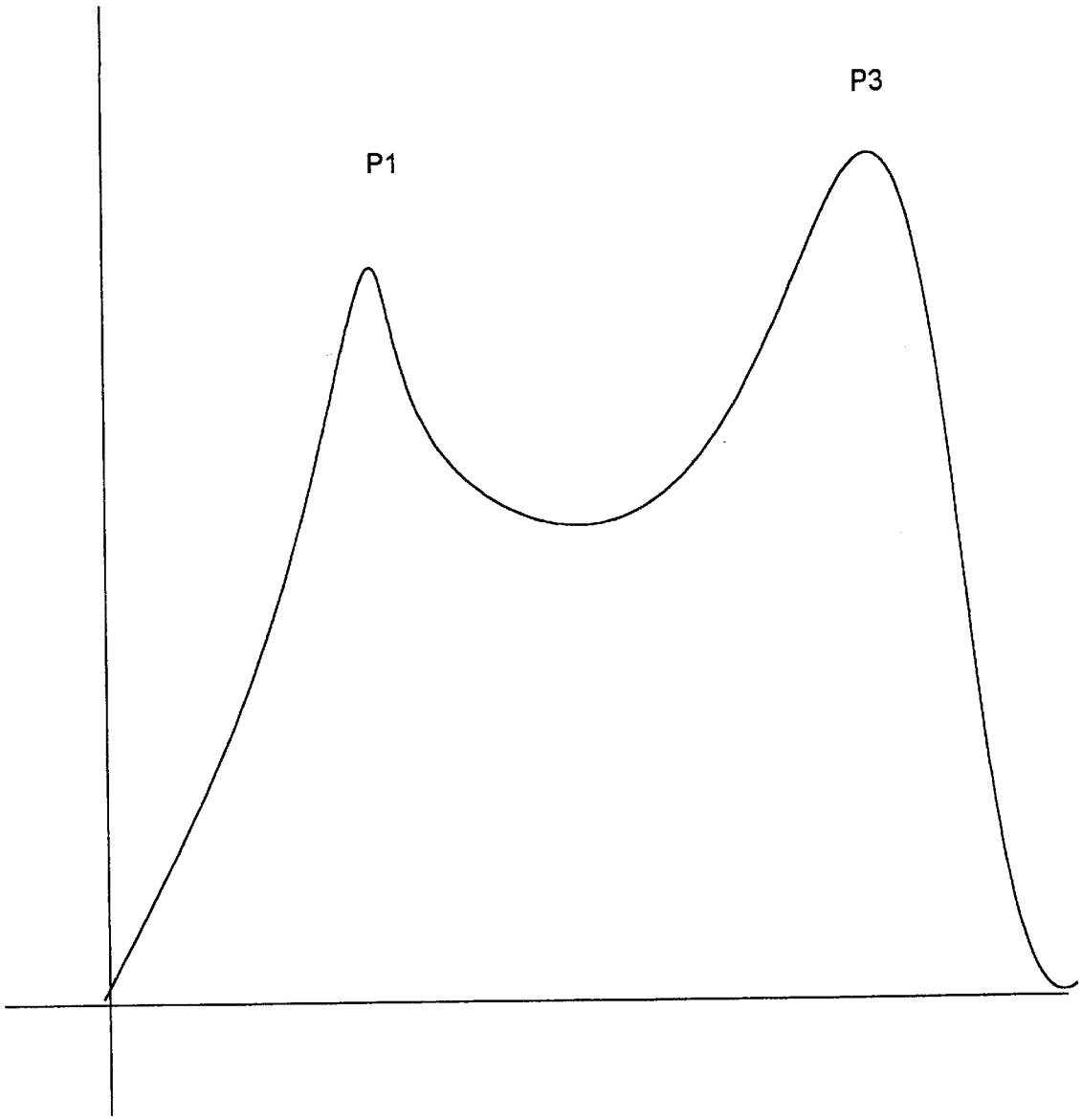
FIG. 2 is a graph of the pressure at points along the locus of points of maximum vertical pressure.

Preferred embodiments for the invention are described in connection with FIGS. 1 through 5. FIG. 1 depicts the sole of a patient's foot 1. The large toe is to the upper right of the figure. During a normal gait the foot undergoes a sequence of stances. It begins with a heal strike where the vertical forces concentrate at the point P1. The patient then advances to a mid stance during which time the locus of the points of maximum pressure follows the curved line 3. As the patient advances the foot enters the propulsion stage during which the maximum pressure advances to the point P3 and forward until toe off, i.e. when the large toe is just touching the floor before clearing it. FIG. 2 is a graph of the magnitude of the pressure at various points along the curve of maximum pressure 3.

As the patient walks there is a lateral rolling motion to the foot rather than a rigid motion as if the ankle were a fixed hinge. This imparts shear forces that tend to be greatest where the curvature of the pressure curve 3 is greatest. This results in a greater tendency to have ulcers form in the region of the ball of the foot below the large toe than at the heel, even though the vertical pressure is high at the heel. The present invention responds to this situation by alleviating the shear forces.

In the prior art, as shown in FIG. 1, curved resilient supports generally indicated as 5 are placed near ulcers or locations where ulcers tend to form, so as to isolate such regions while not being so close to the ulcer regions as to cause lateral stress that aggravate ulcer formation. This is done to reduce the pressure on those locations. The normal orientation of these pads is parallel to the long axis of the foot. Although this relieves the vertical pressure in this area, it does little to relieve the shear force on the surface of the lesion.

Figure 3:
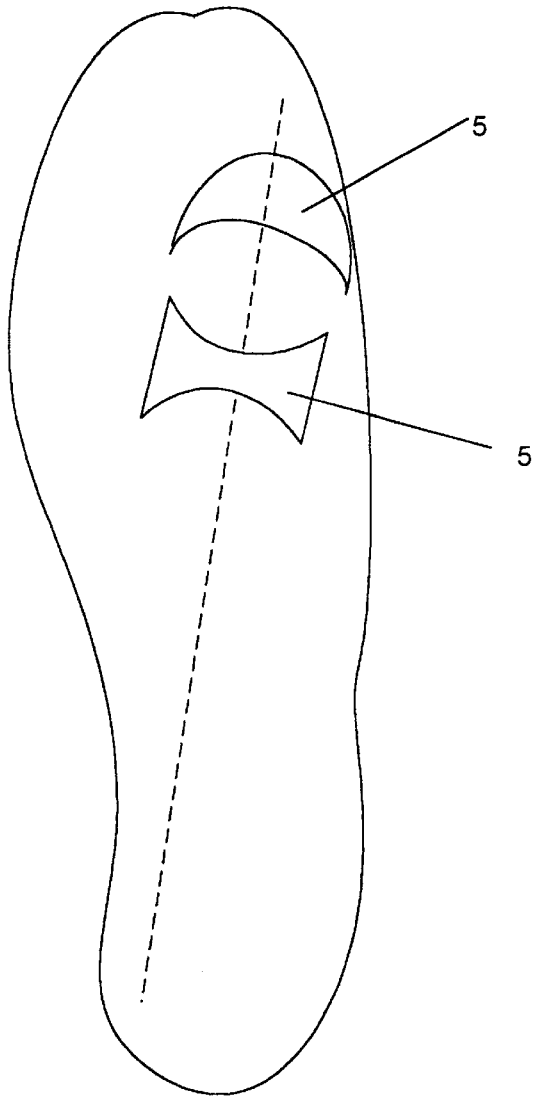
FIG. 3 depicts the average direction of the locus of vertical forces on the foot and indicates the preferred orientation for orthotic pads.

It was discovered that by orienting the supporting pads perpendicular to the resultant line joining the area of maximum pressure during propulsion, as shown in FIG. 3, a significant reduction in the tendency and severity of ulcer formation is achieved. This simple expedient of correctly orienting the axis of arcuate supporting pads achieves a significant improvement in patient recovery.

The pads as shown in FIG. 3 are appropriately located for ulcers in the vicinity of the first metatarsal. Other position of the pads for the 2nd, 3rd, 4th, and 5th metatarsal are similarly located by orienting them along the line from the heal to the point where the ulcer forms with respect to that metatarsal.

Figure 4A:
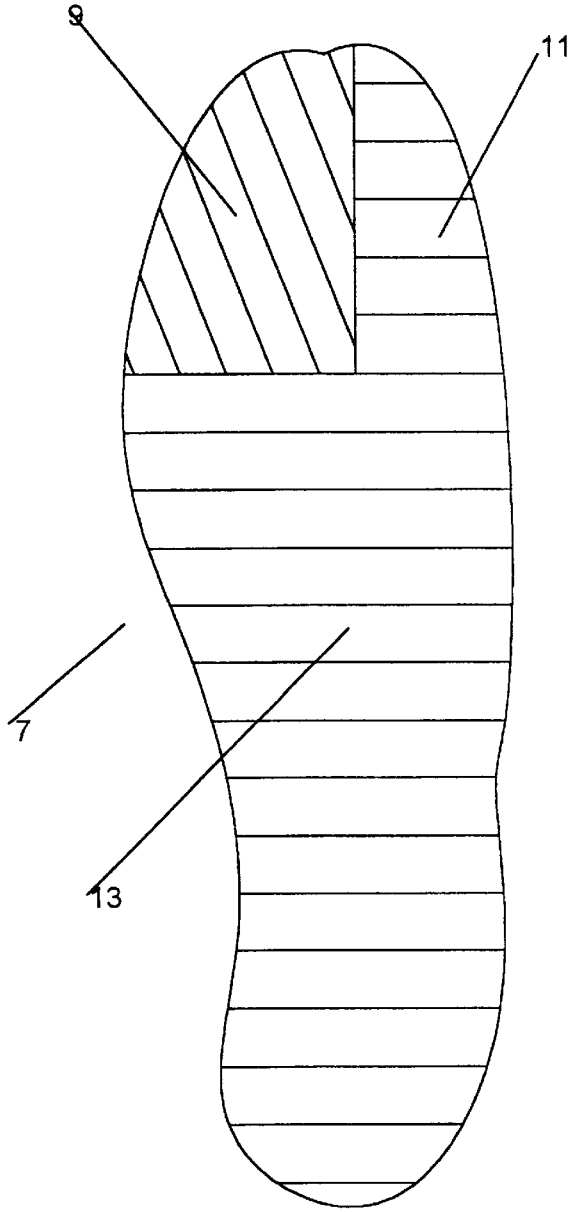
FIGS. 4A and 4B depicts preferred arrangements for a combination of materials for forming a orthotic insole pad.
Figure 4B:
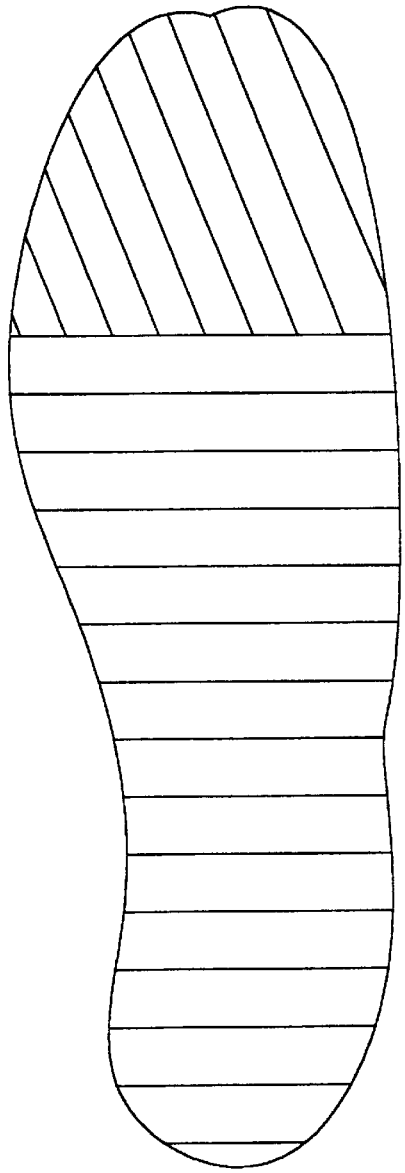

FIG. 4 shows a further embodiment of a supporting structure designed to alleviate the shear forces on the sole of a foot during a gait cycle. An insole pad 7 is made up of alternating strips of materials having different responses to transverse compressive and vertical pressure forces. In a preferred embodiment, layers of PPT and Plastazote are alternated in the pattern depicted in FIG. 4. The PPT is a resilient material, while the Plastazote is moldable.

The result of this structure is that the Plastazote material supports the downward pressure and diffuses it among many structures and the PPT allows the Plastazote to have a relatively great range of transverse plane motion to alleviate the shear forces that would build up at the contact of the foot with the insole. The different areas 9, 11, and 13 of the insole pad 7 are oriented to facilitate the transverse plane motion by having the sections of PPT oriented along the lines of maximum shear.

The pad 7 may be made in different thicknesses, and may be invertible so that one configuration serves both the left foot as shown and the right foot when flipped over. The invention is also not limited to materials having constant durometer values of elasticity. Materials of different durometer values may be combined and are still within the scope of the present invention.

Figure 5:
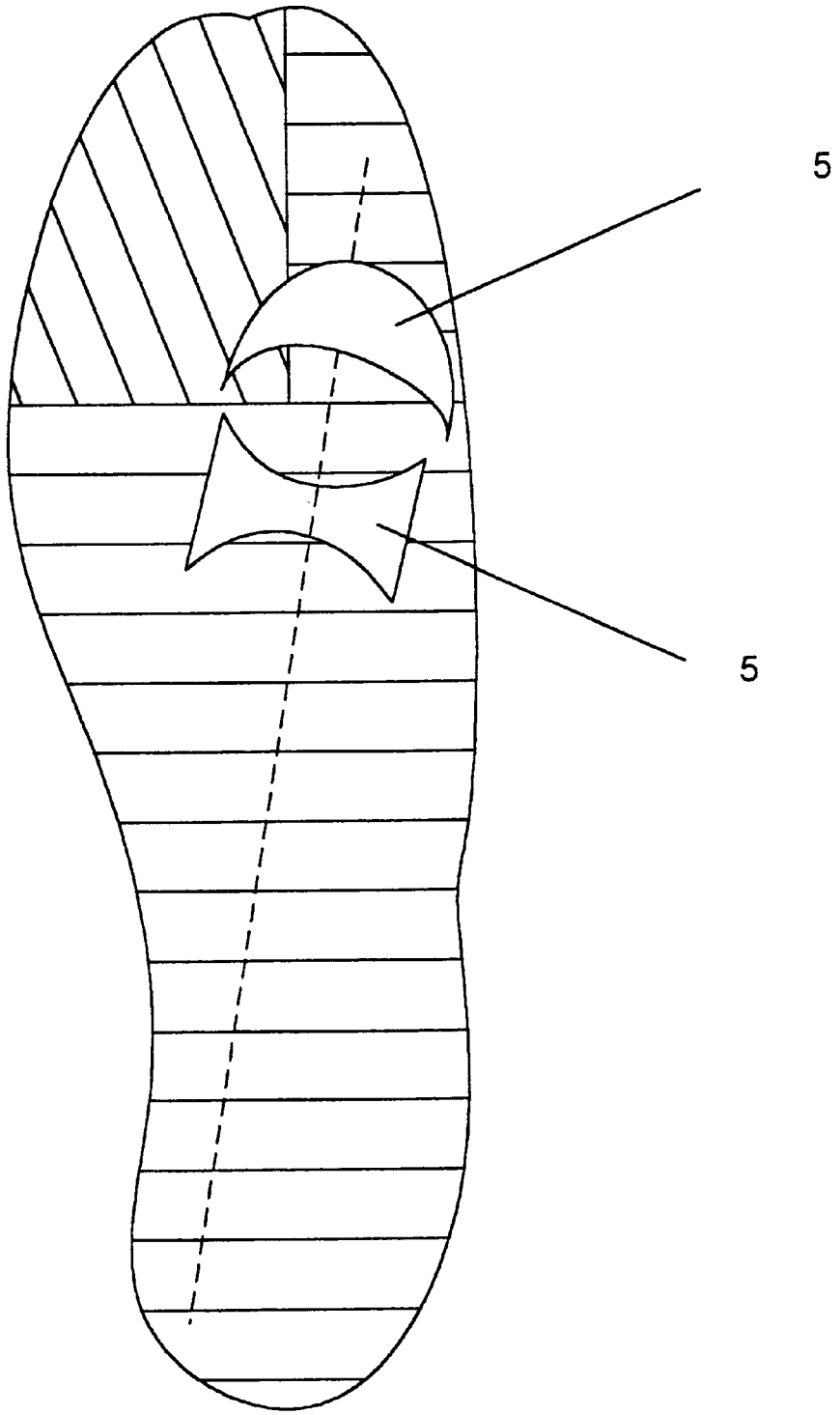
FIG. 5 depicts a preferred arrangement for a combination of materials of different materials forming a orthotic insole pad in conjunction with the preferred orientation for orthoses or inserts.

As shown in FIG. 5, the preferred insole pad may be combined with the supporting pads of the prior embodiment.

What is claimed is:

1. An orthotic pad for a patient comprising first and second alternating vertical strips of resilient material, said first material having a first durometer value sufficient to cushion and support the weight of the patient, and said second material has a durometer value less than that of the first material, wherein during a gait sequence said first material moves laterally to compress said second material, wherein the pad has a ball region, a heel region, and a long axis and the strips have an orientation that varies, and wherein said strip orientation is lateral-medial from the heel region to the ball region and is oriented at an angle with respect to the long axis of the pad from a point proximal to the location of the first metatarsal joint.

2. The orthotic pad for a patient of claim 1, wherein said strip orientation oriented at an angle is oriented in the direction extending from proximal medial to distal lateral.

* * * * *